US007117639B2

(12) United States Patent
Abdella et al.

(10) Patent No.: US 7,117,639 B2
(45) Date of Patent: Oct. 10, 2006

(54) REVERSIBLE DOOR HAVING MORTISE HARDWARE

(75) Inventors: Mark E. Abdella, Saint Paul, MN (US); Keith M. Kibbel, Burnsville, MN (US); John M. Parkhurst, Minnetonka, MN (US); James L. Ralph, Shoreview, MN (US); Todd N. Stratmoen, Mahtomedi, MN (US)

(73) Assignee: Larson Manufacturing Company of South Dakota, Inc., Brookings, SD (US)

( * ) Notice: Subject to any disclaimer, the term of this patent is extended or adjusted under 35 U.S.C. 154(b) by 0 days.

(21) Appl. No.: 10/026,670

(22) Filed: Dec. 21, 2001

(65) Prior Publication Data

US 2002/0108312 A1 Aug. 15, 2002

Related U.S. Application Data

(60) Provisional application No. 60/258,370, filed on Dec. 27, 2000.

(51) Int. Cl.
*E05D 7/02* (2006.01)
*E06B 3/00* (2006.01)

(52) U.S. Cl. ..... 49/382; 49/503

(58) Field of Classification Search ..... 49/382, 49/192, 381, 193; 16/249
See application file for complete search history.

(56) References Cited

U.S. PATENT DOCUMENTS

| | | | |
|---|---|---|---|
| 867,574 | A | 10/1907 | Egge |
| 1,596,952 | A | 8/1926 | Smith |
| 2,620,521 | A | 12/1952 | Fleet |
| 2,703,443 | A | 3/1955 | Lee |
| 2,785,565 | A | 3/1957 | Schlage |
| 3,039,291 | A | 6/1962 | Dusing et al. |
| 3,121,263 | A | 2/1964 | Binner |
| 3,513,674 | A | 5/1970 | Rutherford |
| 3,878,647 | A | 4/1975 | Burgers |
| 4,634,156 | A | 1/1987 | Shimura et al. |
| 4,696,174 | A | 9/1987 | Marks |
| 4,901,493 | A | 2/1990 | Thorn |
| 4,998,598 | A | 3/1991 | Mardian et al. |
| 5,077,948 | A | 1/1992 | Olson et al. |
| 5,161,346 | A | 11/1992 | Olson et al. |

(Continued)

FOREIGN PATENT DOCUMENTS

| | | |
|---|---|---|
| FR | 818535 | 9/1937 |

OTHER PUBLICATIONS

Brochure Entitled "Storm Doors", by Pella, dated 2000, no month available.

(Continued)

*Primary Examiner*—Hugh B. Thompson, II
(74) *Attorney, Agent, or Firm*—Patterson, Thuente, Skaar, Christensen

(57) ABSTRACT

A reversible door (10), having a defined top, includes two notches (11, 12) on opposite sides of the door. A template is provided to fit into one of the notches (11 or 12) and installer drilled holes are formed through the door proximate one of the notches (11 or 12). Then, a mortised handle assembly (15) is positioned through the holes formed in the notch. A hinge assembly is secured to the opposite side of the door from the handle assembly. A snap cover (14) is positioned in the notch that does not have the handle assembly (15). Therefore, the door (10) is reversible without having to be flipped end for end and provides for a reversible door having mortised hardware.

27 Claims, 5 Drawing Sheets

U.S. PATENT DOCUMENTS

| | | | | | |
|---|---|---|---|---|---|
| 5,361,552 | A | | 11/1994 | Fulford | |
| 5,391,245 | A | | 2/1995 | Turner | |
| 5,423,149 | A | * | 6/1995 | Herbst | 49/382 |
| 5,438,808 | A | | 8/1995 | Costello | |
| 5,577,363 | A | | 11/1996 | Tate et al. | |
| 5,620,216 | A | | 4/1997 | Fuller | |
| 5,634,508 | A | * | 6/1997 | Herbst | 49/503 X |
| 5,722,203 | A | | 3/1998 | Staples et al. | |
| 5,822,926 | A | | 10/1998 | Koike et al. | |
| 5,832,670 | A | * | 11/1998 | Bennett | 49/382 |
| 5,839,252 | A | | 11/1998 | Berghorn et al. | |
| 5,887,398 | A | | 3/1999 | Chen | |
| 5,894,706 | A | | 4/1999 | Herbst | |
| 5,947,656 | A | * | 9/1999 | Simson et al. | 408/97 |
| 6,311,454 | B1 | | 11/2001 | Kempel | |
| 6,349,982 | B1 | | 2/2002 | Fayngersh et al. | |
| 6,655,108 | B1 | | 12/2003 | Larson et al. | |
| 6,688,063 | B1 | | 2/2004 | Lee et al. | |
| 7,007,439 | B1 | | 3/2006 | Larson et al. | |
| 2002/0092264 | A1 | | 7/2002 | Larson et al. | |
| 2002/0108312 | A1 | | 8/2002 | Abdella et al. | |

OTHER PUBLICATIONS

"Swing Door Locks", Southco, 1 page, no month and date available.

"Vinyl-Clad Series Storm Doors", Larson Manufacturing, 3 pages, no month and date available.

"202560X V2 Drill Template", Larson Manufacturing, undated, 1 page, no month and date available.

"Drill Template", Larson Manufacturing, 86628 Rev A, undated, 2 pages, no month and date available.

"Right Hinged" Drill Template, Larson Manufacturing, 95942-000 Rev E, undated, 1 page, no month and date available.

"Left Hinged" Drill Template, Larson Manufacturing, 95942-000 Rev E, undated, 1 page, no month and date available.

"Standard Handle Installation", Right Hinged Door Drill Template, Andersen Windows and Doors, undated, 1 page, no month and date available.

"Standard Handle Installation", Left Hinged Door Drill Template, Andersen Windows and Doors, undated, 1 page, no month and date available.

"Handle Drilling and Brass Cover Plate Installation" Instruction Sheet, Andersen Windows and Doors, Revised Dec. 2004, Part No. 612878, 2 pages.

"Right Hinge" Door Template, Pella, Rev. Dec. 16, 2004, Part No. 31199, 1 page.

"Left Hinge" Door Template, Pella, Rev. Dec. 16, 2004, Part No. 31199, 1 page.

"Drill Template", Emco, Rev. Dec. 1, 2003, Part. No. 501406, 1 page.

"Handle Set and Closer Installation Instructions", Printed Jul. 14, 2003, Part No. 501405, 4 pages.

* cited by examiner

FIG. 3
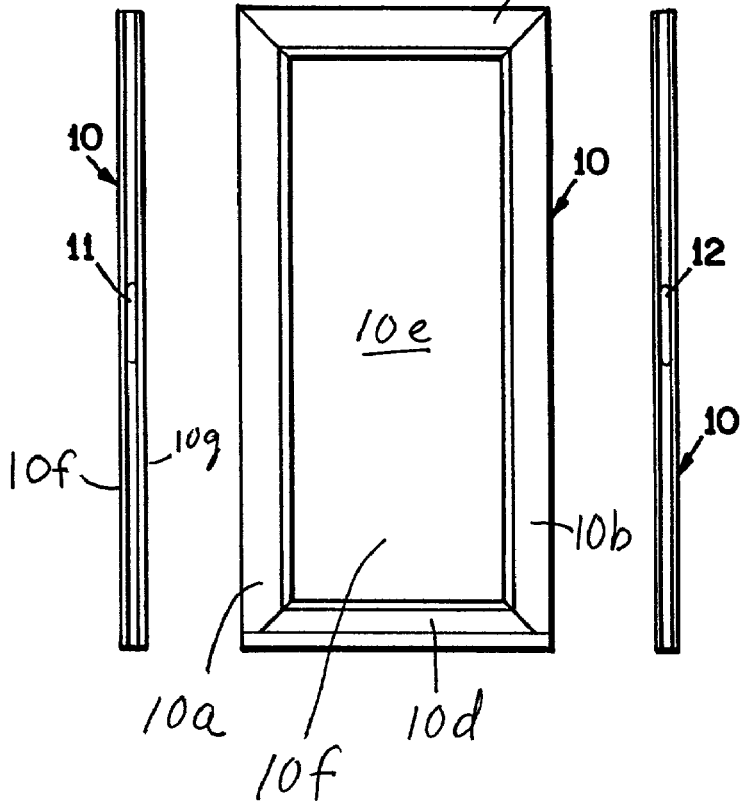
FIG. 1
FIG. 2
FIG. 5
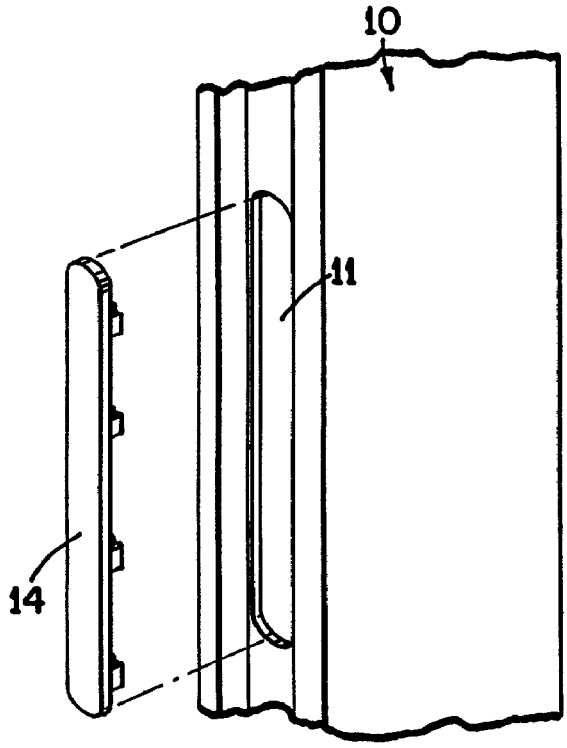

REVERSIBLE DOOR HAVING MORTISE HARDWARE

This application claims benefit of U.S. provisional patent application Ser. No. 60/258,370 filed Dec. 27, 2000.

BACKGROUND OF THE INVENTION

1. Field of the Invention

This invention relates generally to a reversible door, and more particularly to a reversible door that can use mortise hardware.

2. Description of the Prior Art

Doors that are reversible, that is may be hinged on either side, are well known in the art. However, when using such reversible doors in which the design of the door necessitates the door be installed in a particular orientation, it has not been possible to use mortise hardware where the door is reversed by flipping the door end to end. The use of mortise hardware provides for a more aesthetically pleasing door as well as the appearance of a higher quality door. To date, this has not been possible as an effective way of doing so has not been devised.

The present invention addresses the problems associated with prior art devices and provides for the use of mortise hardware with a reversible door that cannot be flipped end to end for reversibility.

SUMMARY OF THE INVENTION

In one embodiment, the invention is a reversible door. The door is generally rectangular having a defined top and having an inner surface and an outer surface, a first side, having a first edge, and a second side, having a second edge, the sides generally perpendicular to the surfaces. A first mortise notch is formed in the first edge of the first side and a second mortise notch is formed in the second edge of the second side. A handle assembly is adapted and configured to be secured in the other one of the mortise notches, wherein the reversible doors is able to be installed with a right hinge or a left hinge.

In another embodiment, the invention is a method of installing a reversible door with a defined top having mortised hardware. The method includes forming a first mortise notch in a first edge of a first side of the door and forming a second mortise notch in the second edge of a second side of the door. A hinge is then secured to one of the sides. Holes are formed proximate the notch of the other of the sides, the holes extending through the door. A mortise handle assembly is then secured in the notch of the other of the sides, thereby providing for a reversible door with mortised hardware assembly.

BRIEF DESCRIPTION OF THE DRAWINGS

FIG. 1 is a front elevational view of a door according to the present invention;

FIG. 2 is a right side elevational view of the door in FIG. 1;

FIG. 3 is a left side elevational view of the door in FIG. 1;

FIG. 5 is a partial exploded perspective view of a portion in FIG. 4 showing in detail the mortise notch;

DETAILED DESCRIPTION OF THE PREFERRED EMBODIMENT

Figure 4:
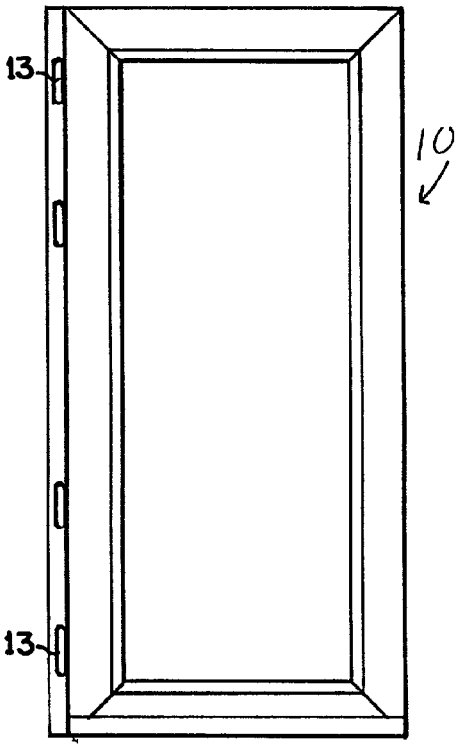
FIG. 4 is a front elevational view showing the door in FIG. 1 with hinges on the left side.
Figure 9:
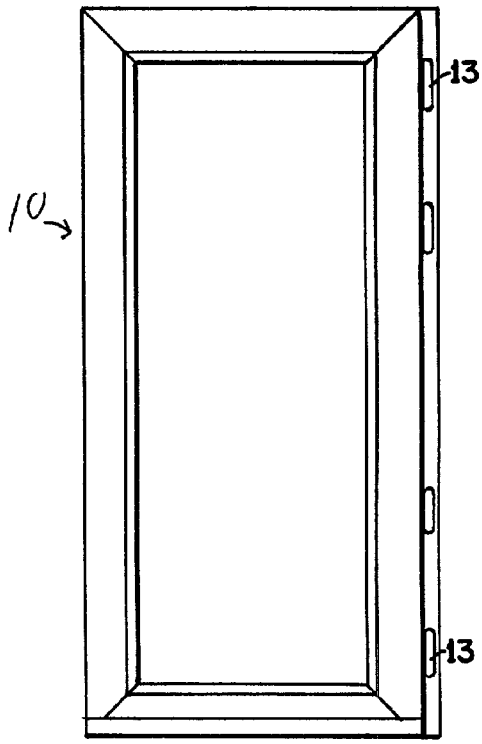
FIG. 9 is a front elevational view of the door shown in FIG. 1 with hinges on the right side.
Figure 6:
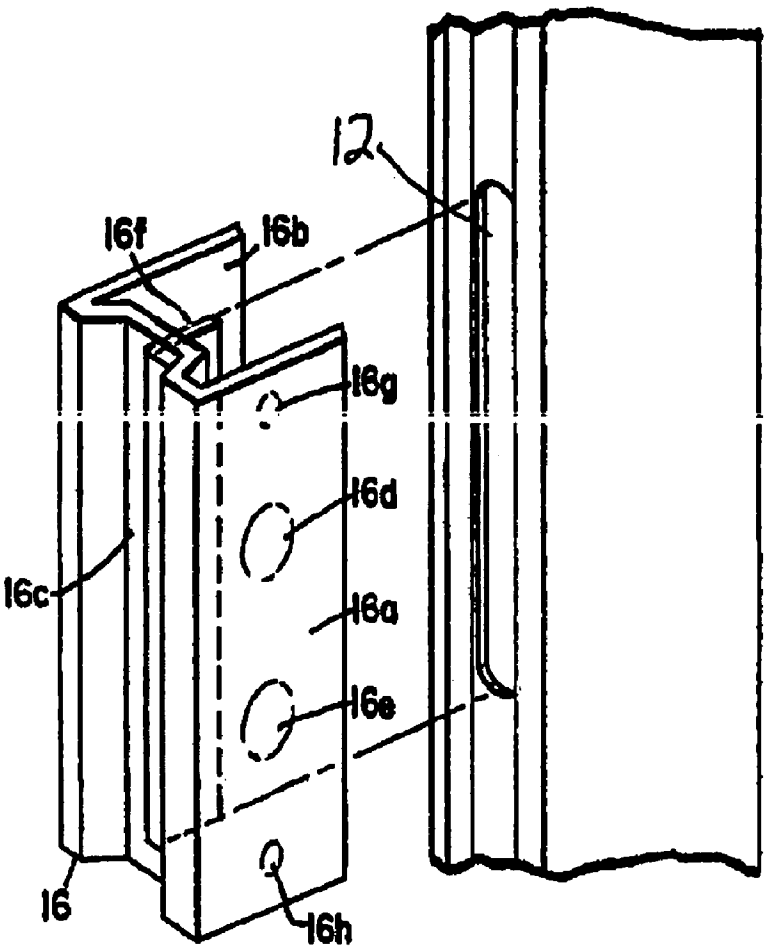
FIG. 6 is a partial exploded perspective view of the right side of the door shown in FIG. 1 and a drilling template.

Referring to the drawings, wherein like numerals represent like parts throughout the several views, there is generally shown at 10 a door. The door 10 includes a frame having a first side 10*a* operatively connected to a second side 10*b* by a top 10*c* and a bottom 10*d*. The frame members 10*a*–10*d* are connected by means well known in the art. A panel 10*e* is positioned in the frame members 10*a*–10*d*. The panel 10*e* may be glass, a plurality of glass panes, or other suitable combinations. Further, the door 10 could be constructed from a single piece of material such as wood or other materials, either single or multiple layer construction, well known in the art. A factory-installed mortise notch 11 is formed in the left side of the door 10. A similar factory installed mortise notch 12 is formed in the right side of the door 10. The sides 10*a*, 10*b* of the frame have a width which is sufficient to allow the mortise notches 11, 12 to be formed therein. A typical size of a mortise 11, 12 is ¾" wide×6" tall. The depth is sufficient to accommodate portions of the handle assembly. The mortises 11, 12 are formed in the edges of sides 10*a*, 10*b*. The panel 10*e* has an outer surface 10*f* and an inner surface 10*g*. The center of the mortise 11, 12 is approximately 40" from the bottom of the door 10. The door 10 is approximately 80" high and can be up to 96" high. When a simple symmetric door construction exists, the mortise slot can be located on one edge, the door can be flipped end for end and the door and hardware configuration will still work. However, the present invention is used when there is not this simple symmetry related to the door construction around a horizontal axis. Such a door can be referred to as a door with a defined top as it will not function properly when flipped end for end. The use of two mortise notches at the same horizontal height overcomes this problem. Further, in FIG. 3, the surfaces are shown as having the same width as the rest of the door. It is understood that for a storm door utilizing glass, the thickness of the panel 10*e* would be often somewhat less than the overall thickness of the frame of the door. FIG. 4 shows hinges 13 installed on the edge of the door for a left hinge installation and FIG. 9 shows hinges 13 installed on the edge of the door for a right hinge installation. The hinges 13, well known in the art, may be secured by any suitable means, well known in the art. A snap-in mortise cover 14 is inserted into the mortise notch 11 if a left hinge installation is desired. The cover plate is sized and configured to cover the mortise notch 11, 12 and may be secured by any suitable method such as a snap fit as shown in the figures. Alternately, a plate could be secured, by suitable means such as screws, over the mortise notch to cover the opening. The mortise cover plate 14 is inserted into the mortise notch 12 if a right hinge installation is desired. The mortise cover plate 14 is installed on the left side 10*a* if a left hinge installation is desired. For the right hinge installation, the hinge 13 is secured to the right side 10*b*. Alternately, for a left side installation, the hinge 13 would be secured to the left side 10*a*, it being seen that the mortise cover plate is attached to the same side as the hinge. A mortised handle assembly, generally designated at 15, is secured through the mortise notch 12 for a left hinge installation and through the mortise notch 11 for a right hinge installation. Only the installation into the mortise notch 12 will be described in detail as it is similar for installation into the mortise notch 11. Referring to FIG. 6, a hole positioning template 16 has a right side 16*a* operatively connected to a left side 16*b* by a side section 16*c*. Formed in the right side 16*a* are two drill hole templates 16*d*, 16*e*. Similar drill hole templates are formed in the left side 16*b* and are in axial alignment with the hole template 16*d*, 16*e*. The hole-positioning template 16 fits around the side of the door and is positioned properly vertically by a mortise locator member 16*f*. The mortise-locating member 16*f* is substantially the same size as the mortise notch 11 and provides for holding the template 16 in position in the mortise notch 11. There is therefore no need to measure to locate the template a certain height as the member 16*f* properly located the template for subsequent drilling.

Figure 7:
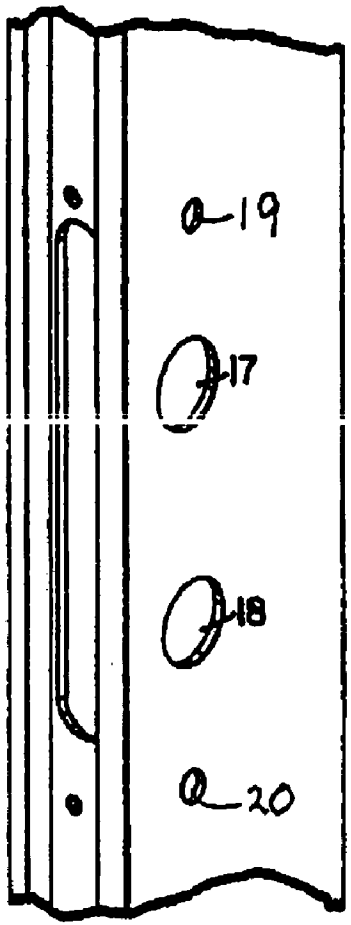
FIG. 7 is a partial exploded view of a portion of the door shown in FIG. 6 with holes being drilled.

Referring to FIG. 7, the installer will then drill holes through the drill hole templates 16*d*, 16*e* to provide for clearance holes 17, 18 formed in the door 10. The holes 17, 18 extend through the width of the door 10. Similarly, the template 16 has two additional drill hole templates 16*g*, 16*h*. The consumer also drills holes through the drill hole templates 16*g*, 16*h* to provide for holes 19, 20 for securing the handle assembly 15 with screws 21. The holes 17–20 are formed proximate the notch and are generally perpendicular to the notch.

Figure 8:
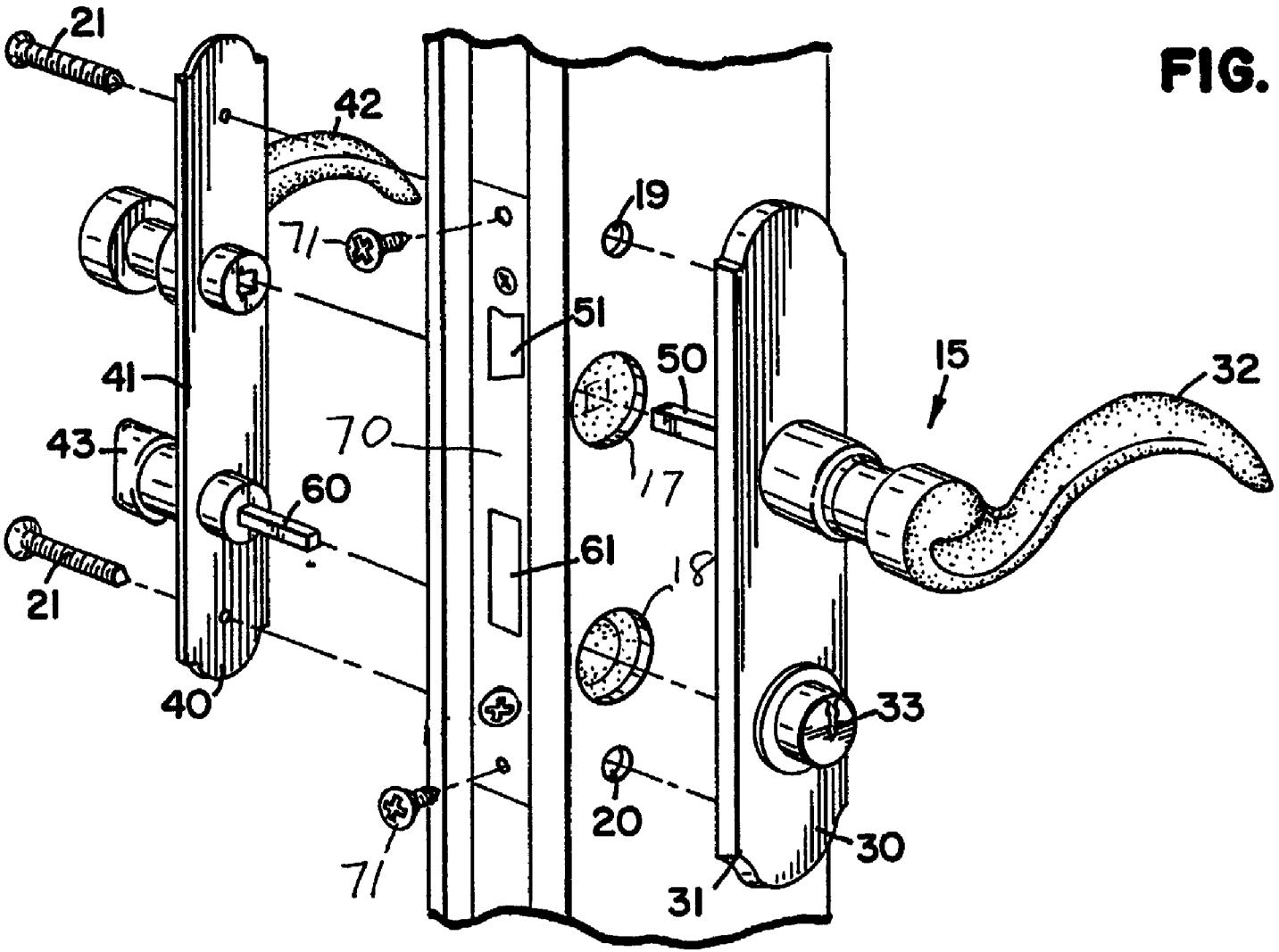
FIG. 8 is an exploded perspective view of a portion of the door show in FIG. 7 with hardware.
Figure 10:
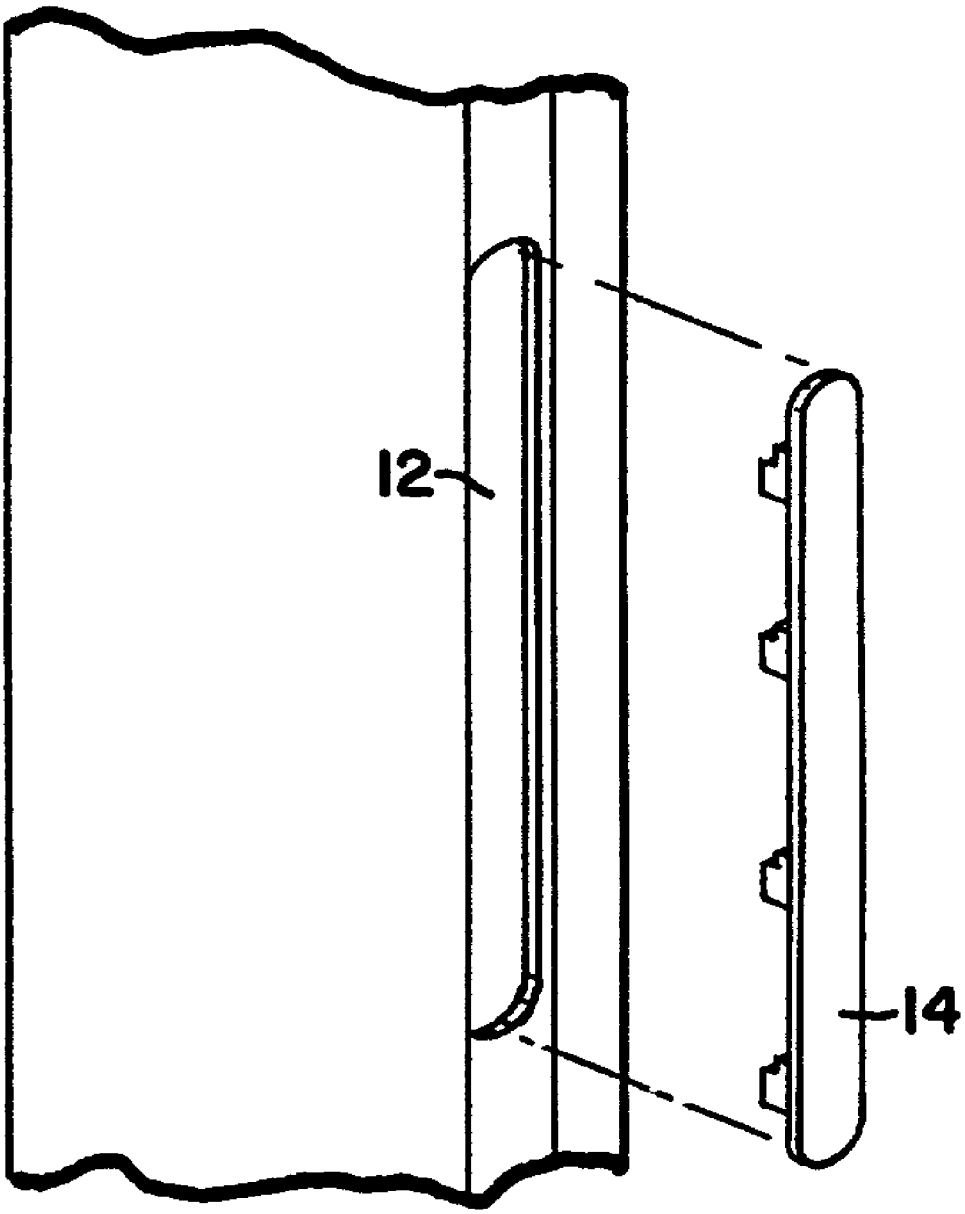
FIG. 10 is an exploded partial perspective view of a portion of the door shown in FIG. 9.

Referring to FIG. 8, the handle assembly 15 includes an exterior handle assembly 30 and an interior trim plate assembly 40. A suitable handle assembly is available from Wright Products, Rice Lake, Wisconsin. The exterior handle assembly 30 includes a plate 31 and a rotatable handle 32 operatively connected to the plate 31. A lock 33 is operatively connected to the plate 31. The handle 32 is sized and configured to be positioned in alignment with hole 17 and the lock 33 is sized and configured to be positioned in alignment with hole 18. The interior trim plate assembly 40 includes a plate 41 having a rotatable handle 42 operatively connected thereto and a rotatable lock knob 43 is also operatively connected to the plate 41. The handle 42 is sized and configured to align with hole 17 and the rotatable lock knob is sized and configured to align with hole 18. The handles 32, 42 are connected by a spindle 50. A livebolt 51 is operatively connected to the rod 50 for latching and unlatching the door 10. The lock 33 and rotatable lock knob 43 are connected by a spindle 60. The spindle 60 is operatively connected to a deadbolt 61 to lock the door 10 into a frame (not shown). The live bolt 51 and deadbolt 61 extend through a plate 70. The plate 70 is secured to the edge of the side 10*a* by screws 71.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A reversible door, comprising:

a generally rectangular door having an inner surface, an outer surface, and first and second side edges generally perpendicular to the inner and outer surfaces;

a first mortise notch formed in the first side edge;

a second mortise notch formed in the second side edge;

a handle assembly configured to be secured in one of the mortise notches, wherein the reversible door is able to be installed with a right hinge configuration or a left hinge configuration;

a cover plate adapted to be secured to either of the mortise notches; and a hole positioning template identifying the location for drilling of at least one mounting hole in the door for mounting the handle assembly, the hole positioning template including a template opening, such that the template opening is generally aligned with one of the first or second mortise notches wherein the hole positioning template wraps around the respective side edge of the door to overlap at least a portion of at least one of the inner or outer surfaces of the door.

2. The reversible door of claim 1 wherein the template opening has substantially the same profile as the mortise notches.

3. The reversible door of claim 1 wherein the cover plate is sized and configured to have a snap fit within the other one of the mortise notches.

4. The reversible door of claim 1 wherein the mortise notches comprise an elongated hole with parallel sides and curved ends.

5. The reversible door of claim 1 wherein the door comprises a hollow core.

6. The reversible door of claim 1 wherein the hole positioning template identifies the location for drilling of at least one mounting hole through at least one of the inner or outer surfaces of the door.

7. The reversible door of claim 1 wherein the hole positioning template further comprises a mortise locating member proximate the template opening, the locating member adapted to properly locate the hole positioning template relative to the mortise notch without the need for additional measuring.

8. The reversible door of claim 1 further comprising two or more hinges, the hinges located separate from the plate cover.

9. A reversible door comprising:

a door body having first and second side edges;

a first mortise opening formed in the first side edge and a second mortise opening formed in the second side edge;

a cover plate configured to be secured to either of the mortise openings; and a removable template including a template opening adapted to be positioned over either of the mortise openings, the template adapted to wrap around at least one of the first and second side edges to overlap at least a portion of outer and inner surfaces of the door body such that the template identifies hole locations at which to drill at least one mounting hole in the door body near the mortise opening, wherein the reversible door is able to be installed in a right hinge configuration or a left hinge configuration.

10. The reversible door of claim 9 comprising a handle assembly configured to be secured in one of the mortise openings and the at least one mounting hole.

11. The reversible door of claim 9 wherein the template opening is substantially the same size as the first and second mortise openings.

12. The reversible door of claim 9 wherein the cover plate is sized and configured to have a snap fit within the other one of the mortise openings.

13. The reversible door of claim 9 wherein the mortise opening comprise an elongated hole with parallel sides and curved ends.

14. The reversible door of claim 9 wherein the mortise openings comprise non-circular holes.

15. The reversible door of claim 9 wherein the door body comprises a hollow core.

16. The reversible door of claim 9 wherein the removable template further comprises a mortise locating member proximate the template opening, the locating member adapted to be positioned in either of the mortise openings to properly locate the removable template relative to the mortise opening.

17. A reversible door comprising:

a door body having first and second side edges;

a first mortise slot formed in the first side edge and a second mortise slot formed in the second side edge;

a cover plate configured to be secured to either of the mortise slots;

at least one mortise lock comprising an exterior profile that slidably mates with either of the first and second mortise slots; and a removable template including a template opening adapted to be positioned over either of the mortise slots, the removable template adapted to wrap around both the first and second side edges to overlap at least a portion of the door body, the template identifying mounting hole locations to facilitate drilling of mounting holes in the door body near the mortise slot usable by the mortise lock, wherein the reversible door is able to be installed in a right hinge configuration or a left hinge configuration.

18. The reversible door of claim 17 wherein the mortise slots each comprise an elongated hole with parallel sides and curved ends.

19. The reversible door of claim 17 wherein the mortise slots each comprise non-circular holes.

20. The reversible door of claim 17 wherein the door body comprises a hollow core.

21. The reversible door of claim 17 wherein the template opening is substantially the same size as the first and second mortise slots.

22. The reversible door of claim 17 wherein the removable template further comprises a mortise locating member proximate the template opening, the locating member adapted to be positioned in either of the mortise slots to properly locate the removable template relative to the mortise slots.

23. A reversible door, comprising:

a generally rectangular door frame comprising first and second side edges;

a first non-circular mortise notch formed in the first side edge and a second non-circular mortise notch formed in the second side edge;

a handle assembly adapted to be inserted into either of the non-circular mortise notches, wherein the reversible door is able to be installed in a right hinge configuration or a left hinge configuration;

a cover plate adapted to be secured to either of the non-circular mortise notches; and a removable mounting hole locating template including a template opening sized to be located over one of the mortise notches so that locations for drilling mounting holes for the handle assembly are accurately identified, the template adapted to wrap around the first and second side edges.

24. A method of installing a reversible door with mortised hardware, comprising the steps of:

forming a first mortise notch in a first side edge of the reversible door;

forming a second mortise notch in a second side edge of the reversible door;

positioning a removable mounting hole locating template over one of the side edges so that a template opening is located over one of the mortise notches and the template wraps around the first or second side edge;

drilling one or more mounting holes identified by the mounting hole locating template;

securing a mortised handle assembly in one of the mortise notches and the mounting holes; and securing a cover plate to the other mortise notch.

25. The method of claim 24 comprising the step of attaching hinges to the side edge having the cover plate.

26. The method of claim 24 wherein the step of forming the first and second mortise notches comprises forming non-circular holes.

27. A method of making a reversible door, comprising the steps of:

forming a first mortise notch in a first side edge of the reversible door;

forming a second mortise notch in a second side edge of the reversible door;

preparing a removable mounting hole locating template comprising a mounting hole locating portion adapted to wrap around the side edges of the door so as to overlap at least a portion of the door, and the locating template having a template opening adapted to be aligned over one of the mortise notches;

assembling at least one mortise lock comprising an exterior profile that slidably mates with either of the first and second mortise notches; and preparing a cover plate adapted to secure to either of the mortise notches.

* * * * *